US007950976B2

(12) United States Patent
Bernstein et al.

(10) Patent No.: US 7,950,976 B2
(45) Date of Patent: May 31, 2011

(54) TOY FOR ROTATING AND LAUNCHING AN OBJECT

(75) Inventors: Michael Bernstein, Hermosa Beach, CA (US); Gabriel Carlson, Los Angeles, CA (US)

(73) Assignee: JAKKS Pacific, Inc., Malibu, CA (US)

( * ) Notice: Subject to any disclaimer, the term of this patent is extended or adjusted under 35 U.S.C. 154(b) by 285 days.

(21) Appl. No.: 12/387,418

(22) Filed: Apr. 30, 2009

(65) Prior Publication Data

US 2009/0227178 A1 Sep. 10, 2009

Related U.S. Application Data

(63) Continuation-in-part of application No. 11/975,721, filed on Oct. 19, 2007, which is a continuation-in-part of application No. 11/183,118, filed on Jul. 14, 2005, now Pat. No. 7,500,898.

(60) Provisional application No. 61/126,098, filed on Apr. 30, 2008.

(51) Int. Cl.
*A63H 29/00* (2006.01)

(52) U.S. Cl. ..... 446/429; 446/39

(58) Field of Classification Search ..... 446/429, 446/430; 74/89.17, 422
See application file for complete search history.

(56) References Cited

U.S. PATENT DOCUMENTS

| | | | |
|---|---|---|---|
| 2,243,780 | A | 5/1941 | Thigpen |
| 3,216,529 | A | 11/1965 | Lohr |
| 3,701,216 | A | 10/1972 | Smith, III et al. |
| 3,735,526 | A | 5/1973 | Ensmann et al. |
| 3,798,832 | A | 3/1974 | Terzian |
| 3,886,682 | A | 6/1975 | Ieda et al. |
| 3,895,458 | A | 7/1975 | Lemelson |
| 3,935,669 | A | 2/1976 | Potrzuski et al. |
| 4,363,186 | A | 12/1982 | Goldfarb et al. |
| 4,498,886 | A | 2/1985 | Goldfarb et al. |
| 4,541,813 | A | 9/1985 | Ikeda |
| 4,659,320 | A | 4/1987 | Rich et al. |
| 4,732,569 | A | 3/1988 | Hippely et al. |
| 4,756,703 | A | 7/1988 | Kennedy et al. |
| 4,889,513 | A | 12/1989 | Paddock |
| 4,959,035 | A | 9/1990 | Murasaki |
| 5,083,799 | A | 1/1992 | Thill |
| 5,370,571 | A | 12/1994 | Bosch |
| 5,536,074 | A | 7/1996 | Hsu et al. |
| 5,580,093 | A | 12/1996 | Conway |
| 5,683,164 | A | 11/1997 | Chien |
| 5,873,600 | A | 2/1999 | Conway |

(Continued)

FOREIGN PATENT DOCUMENTS

| | | |
|---|---|---|
| EP | 0 332 407 | 9/1989 |

(Continued)

*Primary Examiner* — Gene Kim
*Assistant Examiner* — Urszula M Cegielnik
(74) *Attorney, Agent, or Firm* — Tope-McKay & Associates

(57) ABSTRACT

A toy for rotating and launching an object is disclosed. The toy comprises a launcher configured to impart rotary motion to an object. A launcher rotating system is connected with the launcher, and is configured to impart a rotary motion to the launcher. The launcher rotating system engages with a gear rack, the gear rack capable of moving to rotate the launcher rotating system. The launcher rotating system further comprises a clutch mechanism such that continued oscillatory motion of the gear rack causes the launcher rotating system to increase the rotary motion imparted to the launcher and such that withdrawal of the gear rack causes the clutch mechanism to decrease rotary motion imparted to the launcher, whereby a rotating object is released from the launcher.

8 Claims, 8 Drawing Sheets

U.S. PATENT DOCUMENTS

| | | | |
|---|---|---|---|
| 5,957,541 | A | 9/1999 | Seigler |
| 6,364,734 | B1 | 4/2002 | Ng |
| 6,565,243 | B1 | 5/2003 | Cheung |
| 6,619,823 | B2 | 9/2003 | Dai |
| 6,776,458 | B1 | 8/2004 | Wang |
| D498,447 | S | 11/2004 | Kato |
| 6,851,817 | B2 | 2/2005 | Wong |
| 2004/0085777 | A1 | 5/2004 | Wong |
| 2004/0125612 | A1 | 7/2004 | Jackson |
| 2004/0218397 | A1 | 11/2004 | Luo |
| 2004/0257825 | A1 | 12/2004 | Choi et al. |
| 2005/0030756 | A1 | 2/2005 | Thomas et al. |
| 2005/0082774 | A1 | 4/2005 | Chiu |
| 2006/0046609 | A1 | 3/2006 | Laurienzo et al. |
| 2006/0046610 | A1 | 3/2006 | Laurienzo et al. |
| 2006/0099880 | A1 | 5/2006 | Laurienzo et al. |

FOREIGN PATENT DOCUMENTS

| | | |
|---|---|---|
| GB | 374362 | 6/1932 |
| GB | 2 389 321 A | 12/2003 |
| WO | WO 03/076034 | 9/2003 |
| WO | WO 2006/025837 | 3/2006 |

TOY FOR ROTATING AND LAUNCHING AN OBJECT

PRIORITY CLAIM

The present application is a Continuation-in-Part application of U.S. patent application Ser. No. 11/975,721, filed Oct. 19, 2007, entitled "TOY FOR ROTATING AND LAUNCHING AN OBJECT", which is a Continuation-in-Part application of U.S. patent application Ser. No. 11/183,118, filed Jul. 14, 2005, entitled "TOY FOR ROTATING AND LAUNCHING AN OBJECT." The present application is also a non-provisional application of U.S. Provisional Application No. 61/126,098, filed Apr. 30, 2008, entitled "TOY FOR ROTATING AND LAUNCHING AN OBJECT."

BACKGROUND OF THE INVENTION (1) Field of Invention

The present invention relates to a toy for rotating and launching an object and, more particularly, to a toy for rotating and launching an object with a clutch mechanism.

(2) Description of Related Art

Toy launchers are well known in the art. Toys that accelerate and launch gliders, helicopters, cars, and parachutes are well documented. One method of launching a toy is through a rotary motion.

The majority of these toy launchers controls the launching function with a single action and do not provide a mechanism to regulate the rotary motion of a toy separate from the launching.

Thus, a continuing need exists for a toy launcher which allows a user to control the rotary motion of the toy independently from the launching of the toy in order to enhance the overall experience of launching the toy.

SUMMARY OF INVENTION

The present invention relates to a toy for rotating and launching an object. The toy comprises a housing, a launcher, and a launching rotating system. The launcher extends from the housing, and is configured to impart a rotary motion to an object, wherein the launcher comprises a driving element configured to engage a receiving element attached with an object to form a drive connection and rotate the object. The launcher rotating system is mounted inside the housing and connected with the launcher and is configured to impart a rotary motion to the launcher. The launcher rotating system comprises a series of interconnected gears and axles, the gears and axles capable of rotating the launcher and engaging with a gear rack, the gear rack movably mountable within the housing, with the gear rack capable of moving to rotate the gears and thereby rotate the launcher rotating system. The launcher rotating system further comprises a clutch mechanism such that continued oscillatory motion of the gear rack causes the launcher rotating system to increase the rotary motion imparted to the launcher and such that withdrawal of the gear rack causes the clutch mechanism to decrease the rotary motion imparted to the launcher such that when the driving element ceases to accelerate the receiving element, the receiving element disengages from the driving element and releases the object from the drive connection.

In another aspect, the clutch mechanism operates by selectively contacting a braking drum connected with the series of interconnected gears and axles such that contact of the braking drum by the clutch mechanism causes decreased rotation of the launcher rotating system. The clutch mechanism is pushed into contact with the breaking drum by a spring attached with the clutch mechanism. The clutch mechanism further comprises a rack engager having an angled edge configured so that when the gear rack is engaged with the launcher rotating system, the gear rack contacts the angled edge and lifts the clutch mechanism off of the braking drum, thereby allowing the launcher rotating system to rotate. When the gear rack is disengaged from the launcher rotating system, the clutch mechanism is pushed down onto the breaking drum by the spring, thereby decreasing rotation of the launcher rotating system and the launcher, whereby an object attached with the launcher is released.

In a further aspect, the launcher rotating system further comprises a ratcheting drum connected with the series of interconnected gears and axles, the ratcheting drum having internal teeth with angled edges and vertical edges, and further having an internal pawl contacting the teeth. When the gear rack is engaged with the launcher rotating system and pushed forward, it will rotate the pawl in a first direction, such that the pawl slides along the teeth's angled edges without imparting any motion to the ratcheting drum. When the engaged gear rack is pulled back, the pawl is driven in a second direction, where it locks in place against a tooth's vertical edge, thereby imparting rotary motion to the ratcheting drum which, in turn, imparts rotary motion to the launcher. In this manner a user can "rev" the launcher by continually oscillating the gear rack in a back and forth motion.

Finally, as can be appreciated by one skilled in the art, the present invention also comprises a method for forming a toy for rotating and launching an object, as previously described.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

The present invention relates to a toy for rotating and launching an object and, more particularly, to a toy for rotating and launching an object with a clutch mechanism. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

(1) Description

Figure 1A:
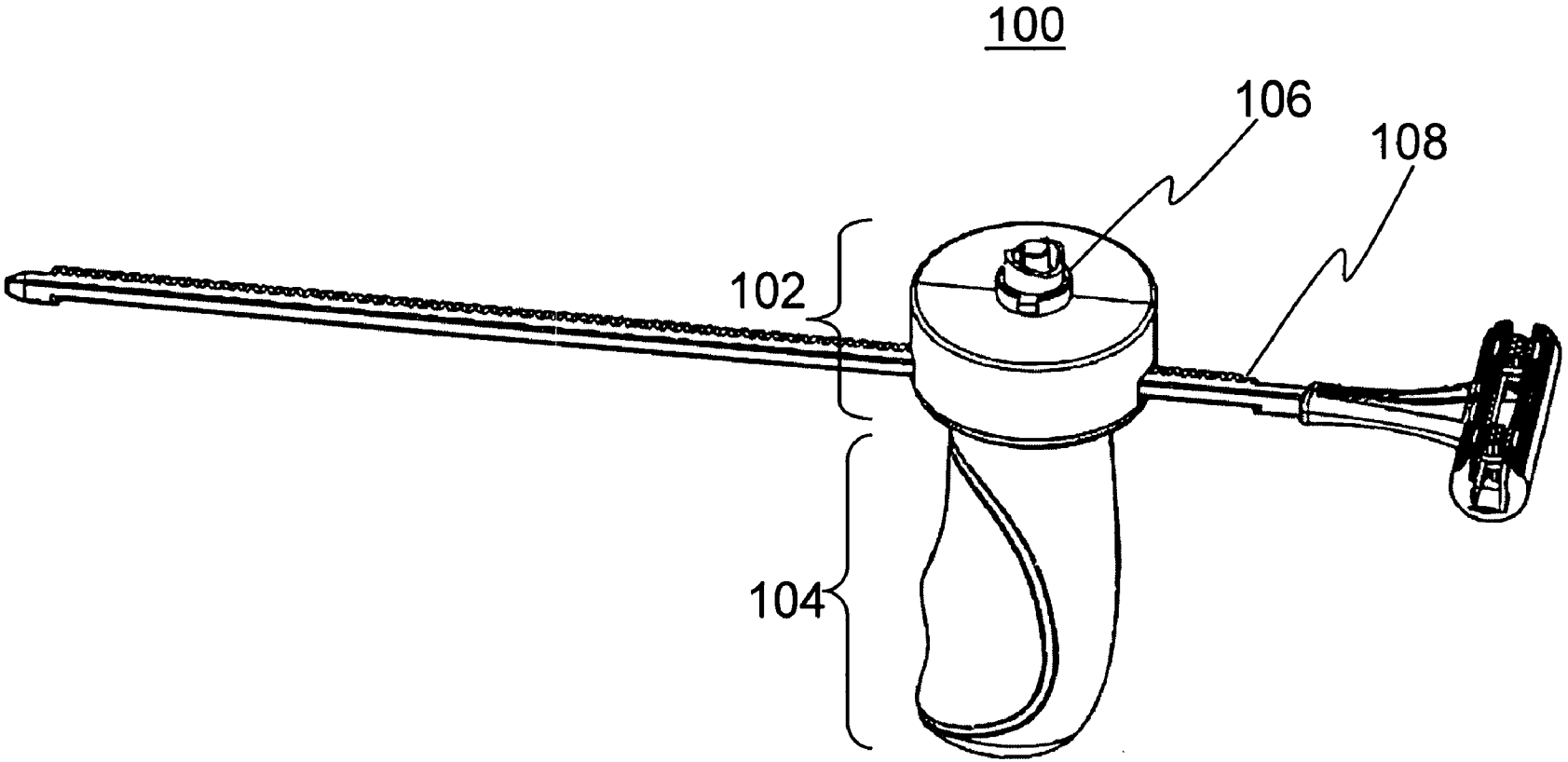
FIG. 1A is an illustration showing a perspective view of a toy for rotating and launching an object according to the present invention.
Figure 1B:
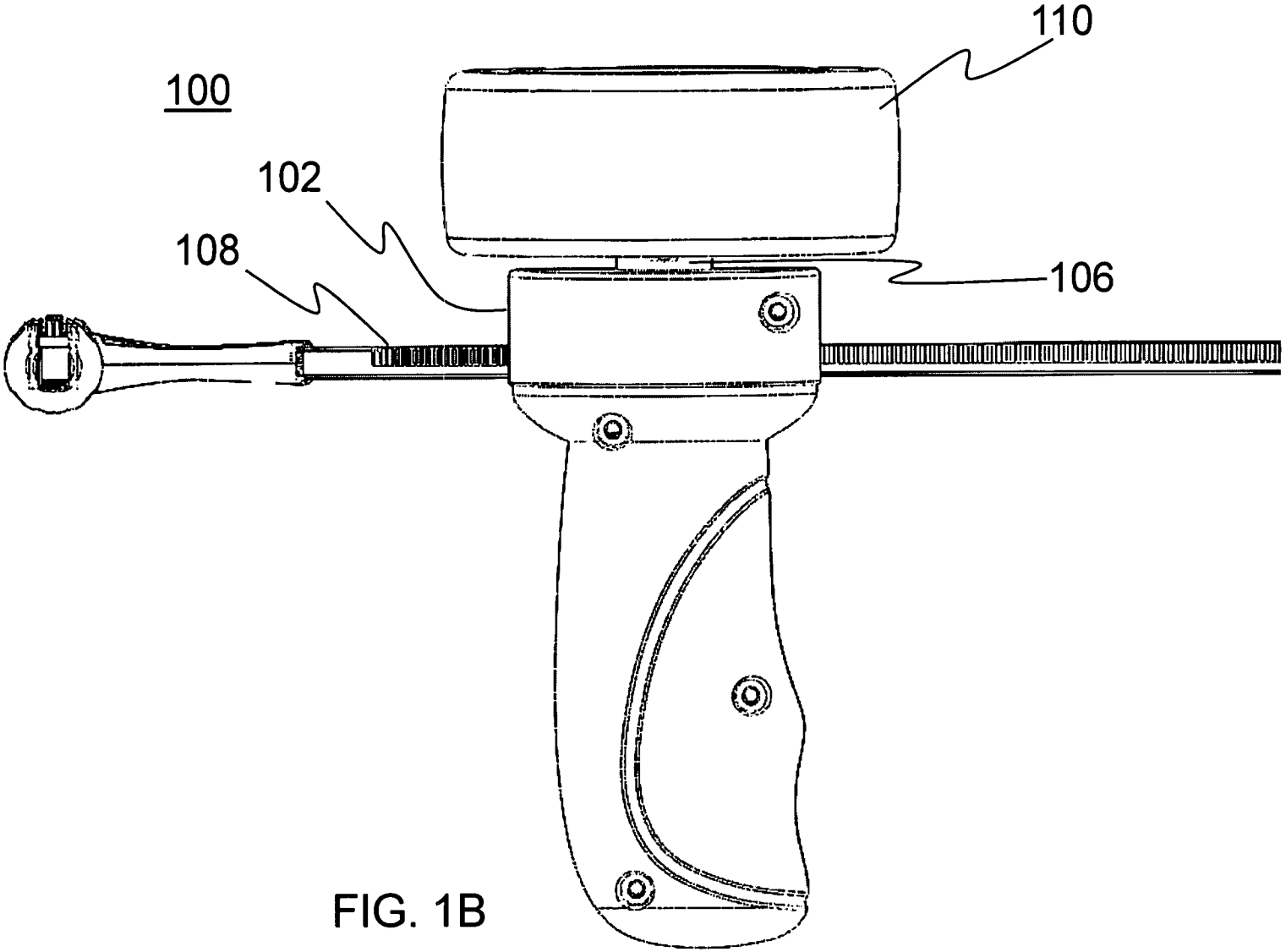
FIG. 1B is an illustration showing a side view of a toy for rotating and launching an object with a wheel mounted on the toy.

The present invention relates to a toy for rotating and launching an object. FIG. 1A illustrates the external components of the device 100. A housing 102 is attached with a handle 104 to allow a user to easily grip the housing 102. In a desired aspect, the handle 104 is detachably attachable with the housing to allow a user to interchange different handles. However, the handle 104 may also be fixed with the housing 102. A launcher 106 extends from the housing 102. The launcher 106 is configured to impart a rotary motion to an object. In a desired aspect, the object is a wheel. FIG. 1B illustrates a side view of the device 100 with a wheel 110 mounted on the launcher 106. In the aspect shown, rotary motion is imparted to the wheel by a user via a rip-chord mechanism. A rip-chord having a gear rack 108 fits into a guideway within the housing 102 where the gear rack 108 operatively engages with a launcher rotating system (not shown), subsequently described with reference to FIGS. 4A and 4B.

Figure 2A:
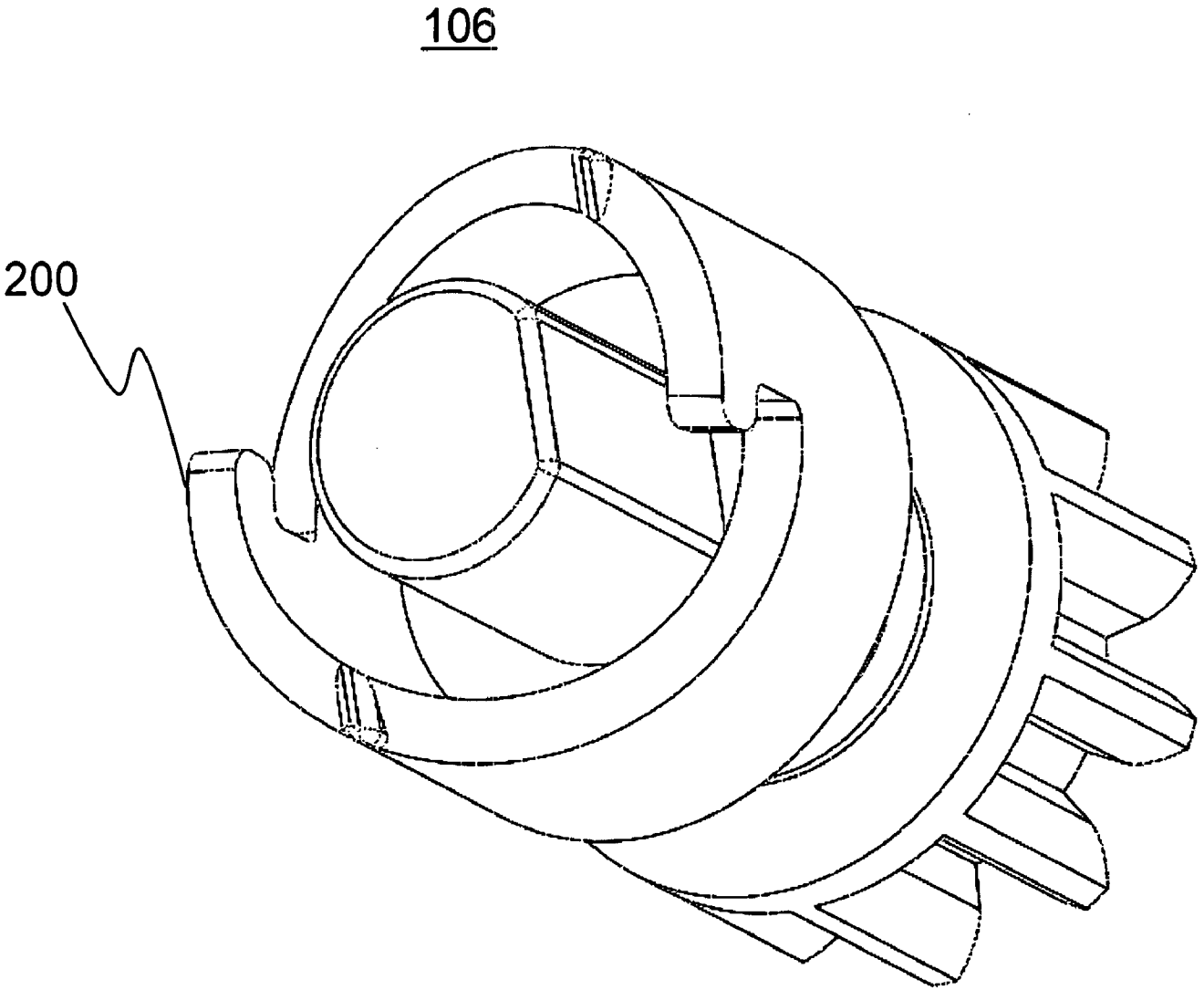
FIG. 2A is an illustration showing the launcher and driving element of the present invention.

FIG. 2A is an illustration of a launcher 106 as previously described. The launcher 106 comprises a driving element 200 configured to engage a receiving element attached with an object to form a drive connection and rotate the object.

Figure 2B:
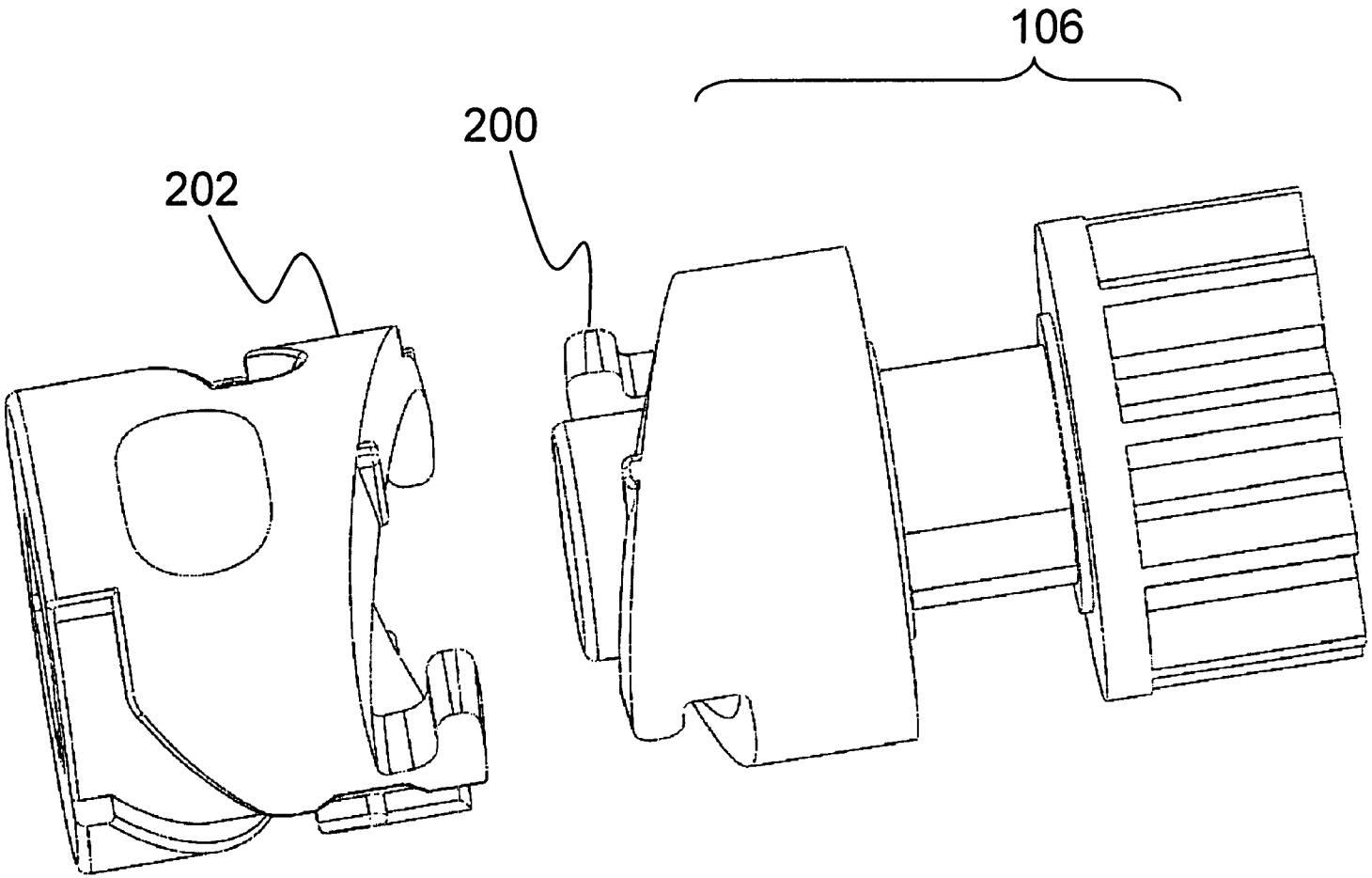
FIG. 2B is an illustration showing the driving element of the launcher of the present invention lined up with the receiving element of a launchable object.

FIG. 2B is a side view illustration showing the launcher 106 with its driving element 200 lined up with a corresponding receiving element 202 of an object.

Figure 2C:
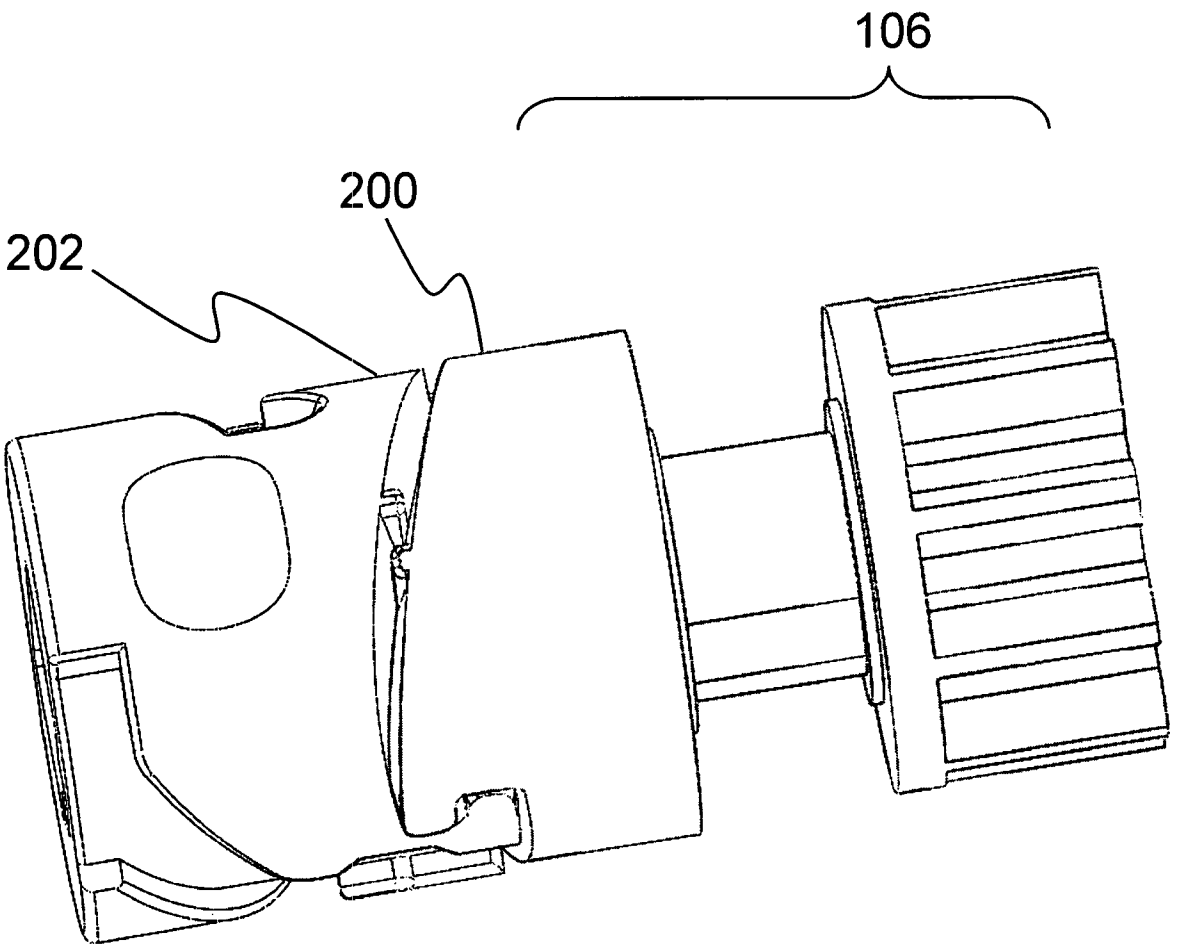
FIG. 2C is an illustration showing the driving element of the launcher of the present invention coupled with the receiving element of a launchable object.

FIG. 2C is a side view illustration showing the driving element 200 of the launcher 106 coupled with the receiving element 202 of an object. The driving element 200 and receiving element 202 are configured such they remain coupled while the driving element 200 is imparting rotary motion to the receiving element 202. Upon cessation of rotary motion of the driving element 200, the receiving element 202 will release from the driving element 200, thereby releasing the object with rotary motion.

Figure 3:
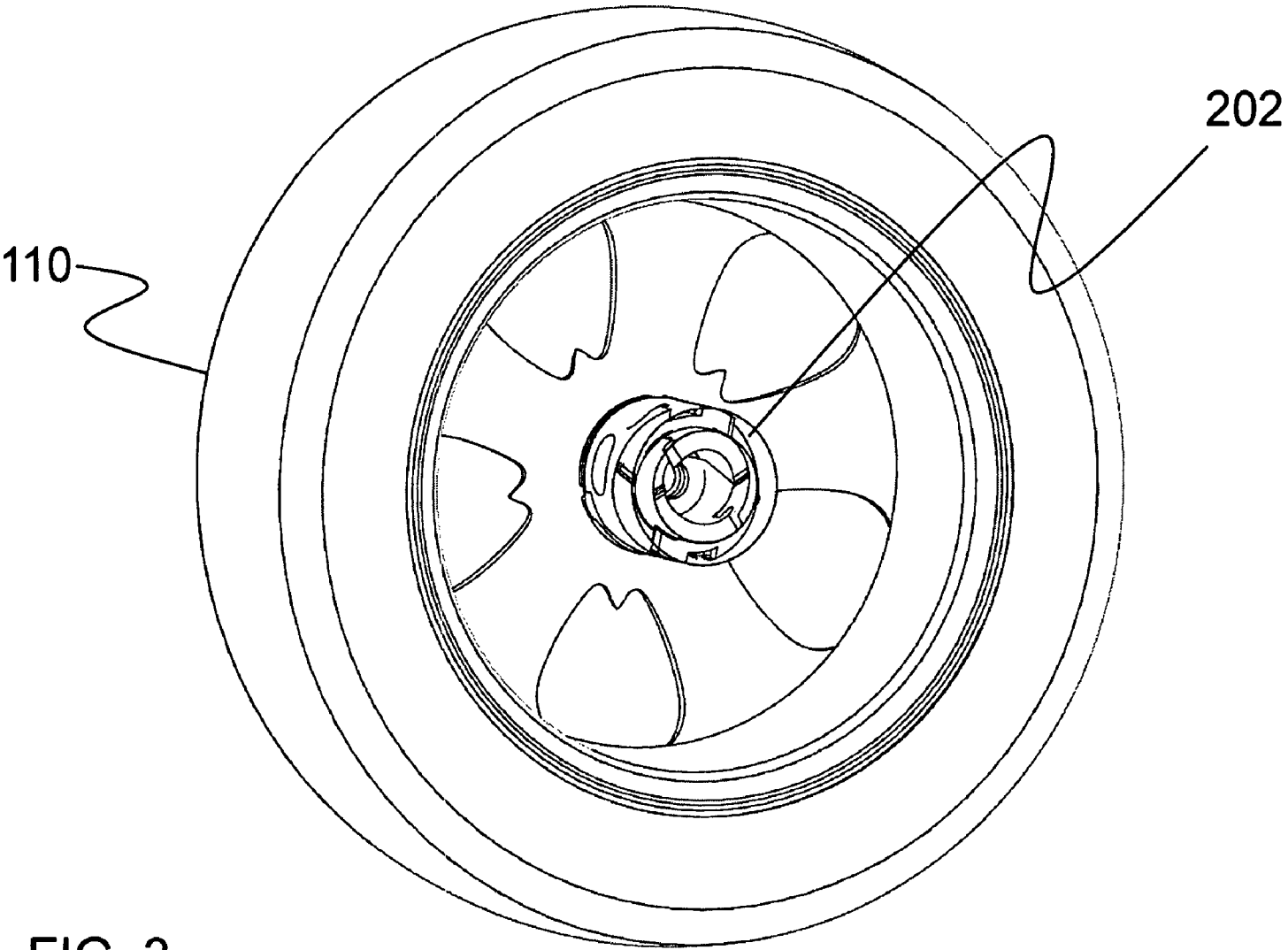
FIG. 3 is an illustration showing a wheel to be launched, the wheel having a receiving element.

FIG. 3 illustrates a wheel 110 for mounting on the device. The wheel comprises a receiving element 202 configured to selectively engage and release with a driving element 200 of the launcher 106 (FIGS. 2A-2C).

Figure 4A:
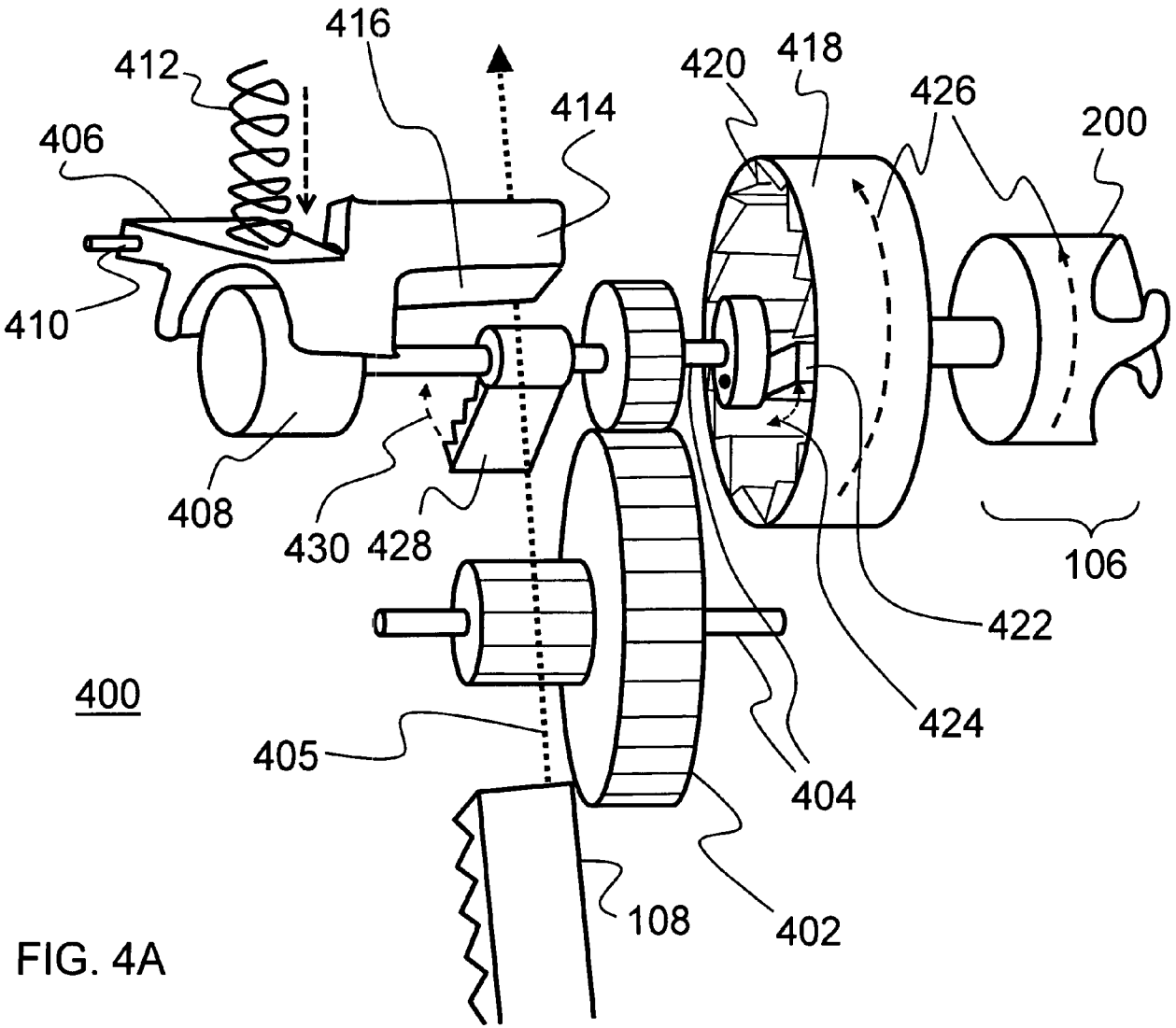
FIG. 4A is an illustrations showing the internal components of the launcher rotating system of the present invention.

The launcher rotating system 400 is illustrated in FIG. 4A. The launcher rotating system 400 is mounted inside the housing and connected with the launcher 106 and configured to impart rotary motion to the launcher 106. All of the components shown in FIG. 4A reside in the housing except for the launcher 106 which extends from the housing, and the gear rack 108 which can be selectively inserted into the housing through a guideway in the housing (not shown, see FIG. 1A). The launcher rotating system 400 comprises a series of interconnected gears 402 and axles 404. The gears 402 and axles 404 engage with the gear rack 108 as it enters the housing and travels along the dotted path 405. The gears 402 and axles 404, when engaged with the gear rack 108, are capable of rotating the gears 402 of the launcher rotating system 400, thereby rotating the launcher 106 and any attached object.

Figure 4B:
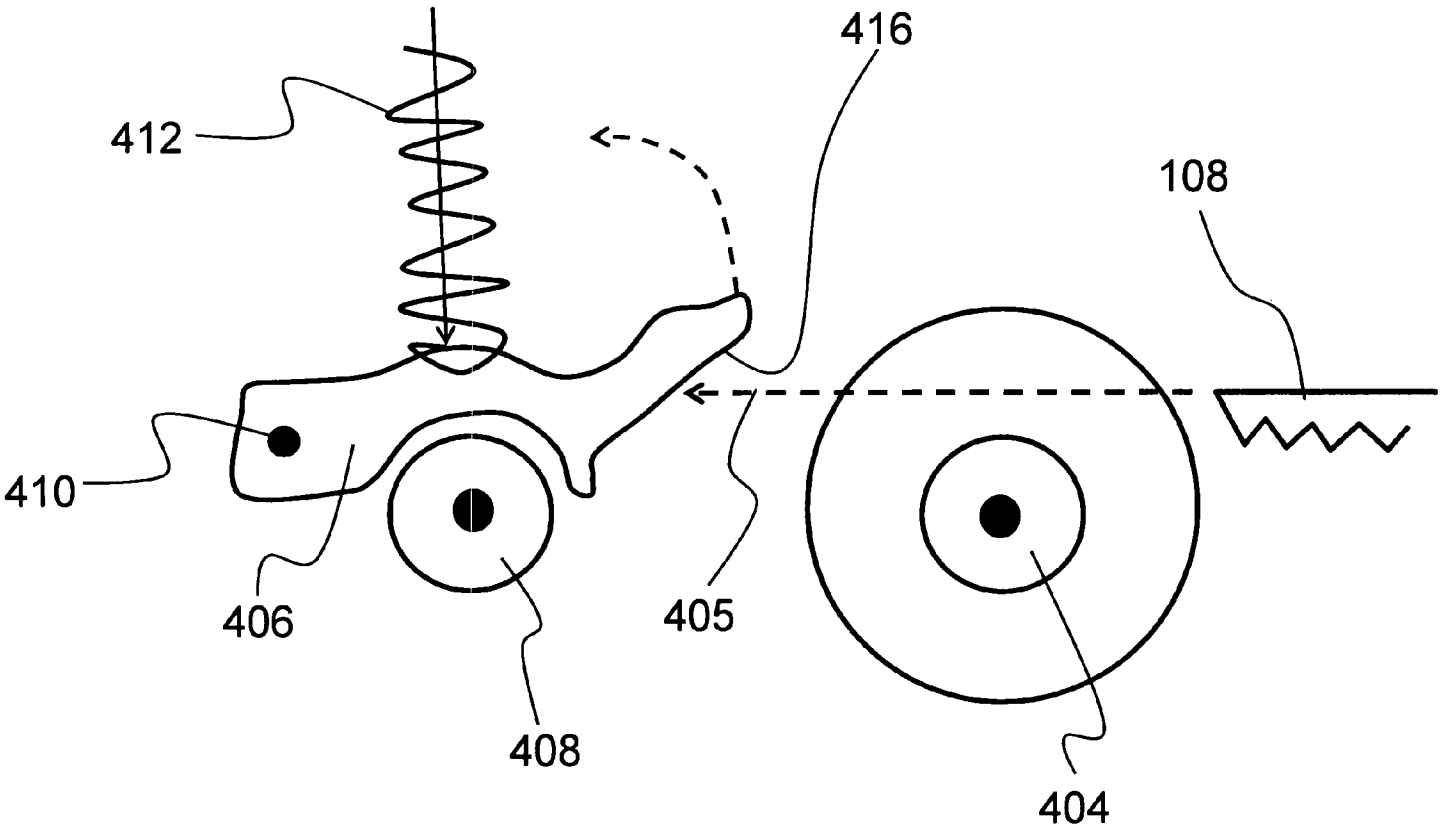
FIG. 4B is an illustration showing a side view of a portion of the launcher rotating system of the present invention.

Still referring to FIG. 4A, the launcher rotating system further comprises a clutch mechanism 406 to allow continued oscillatory motion of the gear rack 108 for causing the launcher rotating system 400 to increase the rotary motion imparted to the launcher 106. The term "oscillatory motion" can broadly denote any type of motion of a periodic nature, such as but not limited to circular motion, pendulum motion, sinusoidal motion, and back and forth linear motion. In a desired aspect of the present invention, oscillatory motion refers to back and forth linear motion similar to the motion one would impart to a hand saw when sawing a piece of wood. Upon withdrawal of the gear rack from the gears 402, the clutch mechanism 406 decreases the rotary motion imparted to the launcher 106 such that when the driving element 200 ceases to accelerate the receiving element of an attached object (not shown, see FIGS. 2A-2C), the receiving element disengages from the driving element 200 and releases the object from the drive connection. More specifically, the clutch mechanism 406 operates by selectively contacting a braking drum 408 which, when contacted, will cause decreased rotation of the system. The clutch mechanism 406 is movable around a pivot point 410. When the gear rack 108 is not engaged with the system, a light spring 412 pushes the clutch mechanism 412 down into contact with the braking drum 408. When the gear rack 108 is inserted into the launcher rotating system along the dotted path 405, the gear rack 108 will contact a rack engager 414 having an angled edge 416. As the gear rack 108 is pushed along the dotted path 405, it will contact the angled edge 416 and lift the clutch mechanism 406 off of the braking drum 408, thereby allowing the launcher rotating system to rotate. FIG. 4B illustrates a side view of the system, where it is more clearly seen how the gear rack 108 contacts the angled edge 416, thereby pushing the clutch mechanism 406 up off of the braking drum 408. Referring back to FIG. 4A, when the gear rack 108 is disengaged from the launcher rotating system, the clutch mechanism 406 is pushed down onto the breaking drum by the force of the spring 412, decreasing rotation of the launcher 106 and thereby releasing any object coupled thereto.

Still referring to FIG. 4A, the launcher rotating system 400 further comprises a ratcheting mechanism, a non-limiting example of which is a ratcheting drum 418 with internal teeth 420 having angled edges and vertical edges. The ratcheting drum also contains an internal pawl 422 contacting the teeth 420. The ratcheting drum 418 allows continued oscillation of the gear rack 108 by a user to impart continued rotary acceleration of the launcher 106. As the engaged gear rack 108 is pushed forward along the dotted path 405, it will rotate the pawl 422 in a first 424 direction, such that the pawl slides along the teeth's 420 angled edges without imparting any motion to the ratcheting drum 418. When the gear rack is pulled back opposite the direction of the dotted path 405, the pawl 422 is driven in a second direction 426, where it locks in place against a tooth's 420 vertical edge, thereby imparting rotary motion to the ratcheting drum 418 which, in turn, imparts rotary motion to the launcher 106. In this manner, a user can "rev" the launcher 106 by continually oscillating the gear rack 108 in a back and forth motion, whereby increased rotary motion will be imparted to the system during each back stroke. It should be noted that one skilled in the art could reverse the gearing mechanism so that the forward stroke is the power stroke, if desired. Referring back to the example in FIG. 4A, upon a final back stroke, the gear rack 108 is disengaged from the system, causing the clutch mechanism 406 to contact the braking drum 408, thereby decreasing rotation of the launcher 106 and causing release of an attached object.

For safety reasons, it is important that the rotating objects are always launched away from the user. A device as depicted in FIGS. 1A and 1B is designed to be gripped by the handle 104 with a user's left hand, with the gear rack 108 powered by the user's right hand. If used in this manner, a rotating object will be released with a counter clockwise rotation 426 as shown in FIG. 4A, thereby causing the rotating object to spin off away from the user. As can be appreciated by one skilled in the art, a safety mechanism should be implemented to prevent a user from operating the device upside down and potentially releasing a rotating object at the user. FIG. 4A shows a non-limiting example of a safety mechanism comprising safety pawl 428 having teeth, the safety pawl 428 attached with the launcher rotating system 400 which, when the device is held in the correct position, hangs down and away from the gear rack (i.e. it is idle). If the system is inverted, as would be the case if a user were attempting to operate the device with the wrong hand, the safety pawl 428 would swing 430 down due to the force of gravity and engage with the teeth of the gear rack 108, thereby disallowing any further movement of the gear rack. In this manner, the system will "lock" if the gear rack 108 is inserted while the device is upside down, thereby preventing a user from launching an object toward the user.

What is claimed is:

1. A toy for rotating and launching an object, comprising:

a housing;

a launcher extending from the housing, the launcher configured to impart a rotary motion to an object, wherein the launcher comprises a driving element configured to engage a receiving element attached with an object to form a drive connection and rotate the object;

a launcher rotating system mounted inside the housing and connected with the launcher, the launcher rotating system configured to impart a rotary motion to the launcher;

wherein the launcher rotating system comprises a series of interconnected gears and axles, the gears and axles capable of rotating the launcher and engaging with a gear rack, the gear rack movably mountable within the housing, with the gear rack capable of moving to rotate the gears and thereby rotate the launcher rotating system; and wherein the launcher rotating system further comprises a clutch mechanism such that continued oscillatory motion of the gear rack causes the launcher rotating system to increase the rotary motion imparted to the launcher and such that withdrawal of the gear rack causes the clutch mechanism to decrease the rotary motion imparted to the launcher such that when the driving element ceases to accelerate the receiving element, the receiving element disengages from the driving element and releases the object from the drive connection.

2. A toy for rotating and launching an object as in claim 1, wherein the clutch mechanism operates by selectively contacting a braking drum connected with the series of interconnected gears and axles such that contact of the braking drum by the clutch mechanism causes decreased rotation of the launcher rotating system, where the clutch mechanism is pushed into contact with the breaking drum by a spring attached with the clutch mechanism, and where the clutch mechanism further comprises a rack engager having an angled edge configured so that when the gear rack is engaged with the launcher rotating system, the gear rack contacts the angled edge and lifts the clutch mechanism off of the braking drum, thereby allowing the launcher rotating system to rotate, and where when the gear rack is disengaged from the launcher rotating system, the clutch mechanism is pushed back down onto the breaking drum by the spring, thereby decreasing rotation of the launcher rotating system and the launcher, whereby an object attached with the launcher is released.

3. A toy for rotating and launching an object as in claim 2, wherein the launcher rotating system further comprises a ratcheting drum connected with the series of interconnected gears and axles, the ratcheting drum having internal teeth with angled edges and vertical edges, the ratcheting drum further having an internal pawl contacting the teeth, such that when the gear rack is engaged with the launcher rotating system and pushed forward, it will rotate the pawl in a first direction, such that the pawl slides along the teeth's angled edges without imparting any motion to the ratcheting drum, and such that when the engaged gear rack is pulled back, the pawl is driven in a second direction, where it locks in place against a tooth's vertical edge, thereby imparting rotary motion to the ratcheting drum which, in turn, imparts rotary motion to the launcher, whereby a user can "rev" the launcher by continually oscillating the gear rack in a back and forth motion.

4. A toy for rotating and launching an object as in claim 1, wherein the launcher rotating system further comprises a ratcheting drum connected with the series of interconnected gears and axles, the ratcheting drum having internal teeth with angled edges and vertical edges, the ratcheting drum further having an internal pawl contacting the teeth, such that when the gear rack is engaged with the launcher rotating system and pushed forward, it will rotate the pawl in a first direction, such that the pawl slides along the teeth's angled edges without imparting any motion to the ratcheting drum, and such that when the engaged gear rack is pulled back, the pawl is driven in a second direction, where it locks in place against a tooth's vertical edge, thereby imparting rotary motion to the ratcheting drum which, in turn, imparts rotary motion to the launcher, whereby a user can "rev" the launcher by continually oscillating the gear rack in a back and forth motion.

5. A method for forming a toy for rotating and launching an object, comprising acts of:

forming a housing;

forming a launcher extending from the housing, the launcher configured to impart a rotary motion to an object, wherein the launcher comprises a driving element configured to engage a receiving element attached with an object to form a drive connection and rotate the object;

forming a launcher rotating system mounted inside the housing and connected with the launcher, the launcher rotating system configured to impart a rotary motion to the launcher;

wherein the launcher rotating system comprises a series of interconnected gears and axles, the gears and axles capable of rotating the launcher and engaging with a gear rack, the gear rack movably mountable within the housing, with the gear rack capable of moving to rotate the gears and thereby rotate the launcher rotating system; and wherein the launcher rotating system further comprises a clutch mechanism such that continued oscillatory motion of the gear rack causes the launcher rotating system to increase the rotary motion imparted to the launcher and such that withdrawal of the gear rack causes the clutch mechanism to decrease the rotary motion imparted to the launcher such that when the driving element ceases to accelerate the receiving element, the receiving element disengages from the driving element and releases the object from the drive connection.

6. A method of forming toy for rotating and launching an object as in claim 5, wherein the clutch mechanism operates by selectively contacting a braking drum connected with the series of interconnected gears and axles such that contact of the braking drum by the clutch mechanism causes decreased rotation of the launcher rotating system, where the clutch mechanism is pushed into contact with the breaking drum by a spring attached with the clutch mechanism, and where the clutch mechanism further comprises a rack engager having an angled edge configured so that when the gear rack is engaged with the launcher rotating system, the gear rack contacts the angled edge and lifts the clutch mechanism off of the braking drum, thereby allowing the launcher rotating system to rotate, and where when the gear rack is disengaged from the launcher rotating system, the clutch mechanism is pushed back down onto the breaking drum by the spring, thereby decreasing rotation of the launcher rotating system and the launcher, whereby an object attached with the launcher is released.

7. A method of forming a toy for rotating and launching an object as in claim 6, wherein the launcher rotating system further comprises a ratcheting drum connected with the series of interconnected gears and axles, the ratcheting drum having internal teeth with angled edges and vertical edges, the ratcheting drum further having an internal pawl contacting the teeth, such that when the gear rack is engaged with the launcher rotating system and pushed forward, it will rotate the pawl in a first direction, such that the pawl slides along the teeth's angled edges without imparting any motion to the ratcheting drum, and such that when the engaged gear rack is pulled back, the pawl is driven in a second direction, where it locks in place against a tooth's vertical edge, thereby imparting rotary motion to the ratcheting drum which, in turn, imparts rotary motion to the launcher, whereby a user can "rev" the launcher by continually oscillating the gear rack in a back and forth motion.

8. A method of forming a toy for rotating and launching an object as in claim 5, wherein the launcher rotating system further comprises a ratcheting drum connected with the series of interconnected gears and axles, the ratcheting drum having internal teeth with angled edges and vertical edges, the ratcheting drum further having an internal pawl contacting the teeth, such that when the gear rack is engaged with the launcher rotating system and pushed forward, it will rotate the pawl in a first direction, such that the pawl slides along the teeth's angled edges without imparting any motion to the ratcheting drum, and such that when the engaged gear rack is pulled back, the pawl is driven in a second direction, where it locks in place against a tooth's vertical edge, thereby imparting rotary motion to the ratcheting drum which, in turn, imparts rotary motion to the launcher, whereby a user can "rev" the launcher by continually oscillating the gear rack in a back and forth motion.

* * * * *